US006880300B2

(12) United States Patent
Hawkes

(10) Patent No.: US 6,880,300 B2
(45) Date of Patent: Apr. 19, 2005

(54) WINDOW WELL

(76) Inventor: Brett L. Hawkes, 1751 N. 1700 E., Layton, UT (US) 84040

( * ) Notice: Subject to any disclaimer, the term of this patent is extended or adjusted under 35 U.S.C. 154(b) by 0 days.

(21) Appl. No.: 10/284,822

(22) Filed: Nov. 1, 2002

(65) Prior Publication Data

US 2004/0083661 A1 May 6, 2004

(51) Int. Cl.[7] ..... E04F 17/06; E06B 5/02
(52) U.S. Cl. ..... 52/107; 52/169.7; 52/741.11
(58) Field of Search ..... 52/107, 169.7, 52/741.11

(56) References Cited

U.S. PATENT DOCUMENTS 3,099,900 A * 8/1963 Beck ..... 52/742.15
3,999,334 A * 12/1976 Webb ..... 52/20
4,876,833 A * 10/1989 Gefroh et al. ..... 52/107
5,107,640 A * 4/1992 Gefroh et al. ..... 52/107
5,271,195 A * 12/1993 Wahe ..... 52/107
5,339,579 A * 8/1994 Woodyer et al. ..... 52/107
6,484,455 B1 * 11/2002 Poole ..... 52/107
2003/0167705 A1 * 9/2003 Oakley ..... 52/107

* cited by examiner

*Primary Examiner*—Brian E. Glessner
(74) *Attorney, Agent, or Firm*—Brian C. Trask

(57) ABSTRACT

A rust-proof window well manufactured from a composite material. The window well may have integrally formed steps to assist in egress from inside the well. Walls forming the well typically are ¼ inch thick, or greater. While generally made with a spray-up process from a glass/epoxy composite, the well may be manufactured from a variety of composite materials with corresponding manufacturing techniques.

21 Claims, 5 Drawing Sheets

WINDOW WELL

BACKGROUND

1. Field of the Invention

The invention pertains to structure capable of spacing a landscape fill apart form a below-grade window.

2. State of the Art

Window well structures are used to space a landscape fill, including materials such as dirt, rocks, plants, and timbers, away from a below-grade window. The window well desirably defines sufficient open space exterior to the window to permit natural light to enter the room in which the window is installed. Furthermore, as mandated by modem building codes, the window well must be configured to permit a person to exit the window, and climb out of the window well, to provide an escape route from the building. Window wells desirably are durable to resist rust and to maintain a shape and appearance without requiring significant maintenance.

One commonly used window well structure is formed from corrugated and galvanized sheets of steel. The corrugated steel typically is formed into a broad U-shape having a depth to space fill apart from a window. The tops of the U-shape are fastened to a house foundation to span the window. While economical, and relatively easy to install, such window wells inherently have an industrial appearance that many home owners find distasteful. The metallic and wavy surface of such window wells can conjure up the image of a garbage can. Furthermore, while a galvanized coating promotes resistance to rust, walls and attach hardware of such window wells still are prone to rusting and corrosion, with attendant unsightly staining. Ends of the U-shape typically are bolted, or otherwise attached, to flanges for installation onto a foundation. The wavy corrugations can leave gaps at the flange connection which sometimes permit infiltration of dirt and moisture into the window well.

Certain alterations to galvanized window wells are possible. Some homeowners may resort to painting the galvanized window wells to improve their appearance. However, the galvanized surface generally does not hold paint well, thereby frustrating a homeowner's desire for a low maintenance window well. A liner, made from a flexible synthetic material, is commercially available for placement interior to a galvanized window well to provide a more pleasing appearance from inside the house. However, when adding a liner, a homeowner pays for two structures to do the job an efficiently constructed window well can do. A stone facade or stucco-like material may also be applied to certain window wells to provide an improved cosmetic appearance to a viewer from inside a dwelling.

Alternatives to corrugated window wells are also available, including window wells made from cement. Cement window wells can provide an appearance of massive, or solid construction, which can constitute a portion of an architectural image presented by the house. Such cement window wells are tremendously heavy, and therefore are generally cast in place. A precast cement window well would require a crane to lift and place the window well into an installed position. Window wells also may be made from stones, brick, or block, with the constituent materials typically being laid in a mortar binder one piece at a time. A considerable amount of labor is required to form such window wells in-situ, and therefore such structures are relatively expensive.

One requirement, mandated by modern building codes, is for window wells over a certain depth to provide some sort of structure to assist in egress of a person. Some window wells may have permanently installed ladders to satisfy such code requirements. Other window wells, such as certain of those constructed in-situ, may have step structure formed into one, or more, wall of the window well. Especially in the case of deep window wells requiring step structure, a safety cover is desired to prevent people or objects from falling into the window well.

BRIEF SUMMARY OF THE INVENTION

The present invention provides an apparatus and methods for making and installing a window well. The invention can be embodied as a window well weighing less than about 400 pounds to permit its installation without requiring a crane or lifting device. A window well according to the invention typically operates as a rust-proof containment surround defining a volume to space a landscape fill apart from a below-grade window. A well desirably includes a plurality of egress steps formed in a wall of the surround. A mow strip configured to accommodate a grade in the landscape fill also may be included. Certain window wells may have a support ledge formed in a wall of the surround, with the ledge being adapted to hold a safety cover over a top opening of the well.

A window well according to the invention can be used in combination with a safety cover such as a grate. A safety cover can also be substantially transparent, and operate as a water resistant barrier. Desirable window wells are rust-proof, and have walls formed from a composite material. Walls are typically formed from a composite material selected from the group consisting of: glass-epoxy, carbon-epoxy, glass-ester, glass-thermoforming compound, glass-thermosetting compound, x-thermoforming compound, and x-thermosetting compound, where x is a fiber.

A window well according to the invention may be characterized as a three-sided container including premanufactured first, second, and third walls, and having an open top. Such first and third walls each carry attach structure on their first end, with the attach structure being adapted to attach to foundation structure of a house. The second ends of the first and third walls are connected to the second wall to enclose a volume in front of a window of the house. It currently is preferred for a second wall to include integral egress steps. The window well desirably is formed by premanufacturing as a unitary structure defining a volume prior to installation of the window well onto a house. In any case, the walls of a window well according to the invention generally have walls greater than about ¼ inch in thickness.

The invention can be embodied as an improved window well of the type having prefabricated walls adapted to space a landscape fill material apart from a below-grade window. The improved window well has egress steps formed as an integral portion of one of the walls. Certain embodiments may have a support formed at a top of the walls and operable to hold a window well cover. Desirable support structure includes a shelf adapted to hold the cover. In any case, window well walls typically have a thickness greater than about ¼ inch. In certain embodiments of the invention, walls have a thickness between about ¼ and about ¾ inches. Other embodiments may have walls with a thickness between about ¼ and about 4 inches. Sometimes walls can include a sandwich construction having a core disposed between top and bottom face sheets. Other walls can be of a monocoque construction. One attribute available in embodiments of the invention is for preformed walls to include areas having substantially no curvature along a vertical path. Such areas of no curvature may be perceived as being more restful to gaze upon than a commercially available corrugated wall.

One method of installing a window well according to the invention to a foundation of a building, to space a landscape fill apart from a below-grade widow, includes the steps of: a) providing a window well comprising a wall with integral egress steps; b) attaching a flange of a wall of the window well to the foundation; and c) back-filling the landscape fill into a position about an exterior of the window well. The method may further include the step, prior to step b), of: applying a caulking compound to an attach surface of the flange.

A method for manufacturing a window well according to the invention typically includes the steps of: a) providing a mold having a shape of the window well; b) applying an uncured material to the mold; c) curing the material; and d) removing the cured material from the mold. The material generally is selected from the group including: glass-epoxy, carbon-epoxy, glass-ester, glass-thermoforming compound, glass-thermosetting compound, x-thermoforming compound, and x-thermosetting compound, where x is a fiber. A workable approach to apply material to a mold is to spray the material and resin onto the mold surface with a chopper gun.

BRIEF DESCRIPTION OF THE DRAWINGS

In the drawings, which illustrate what are currently considered to be the best modes for carrying out the invention.

DETAILED DESCRIPTION OF THE ILLUSTRATED EMBODIMENT(S)

Figure 1:
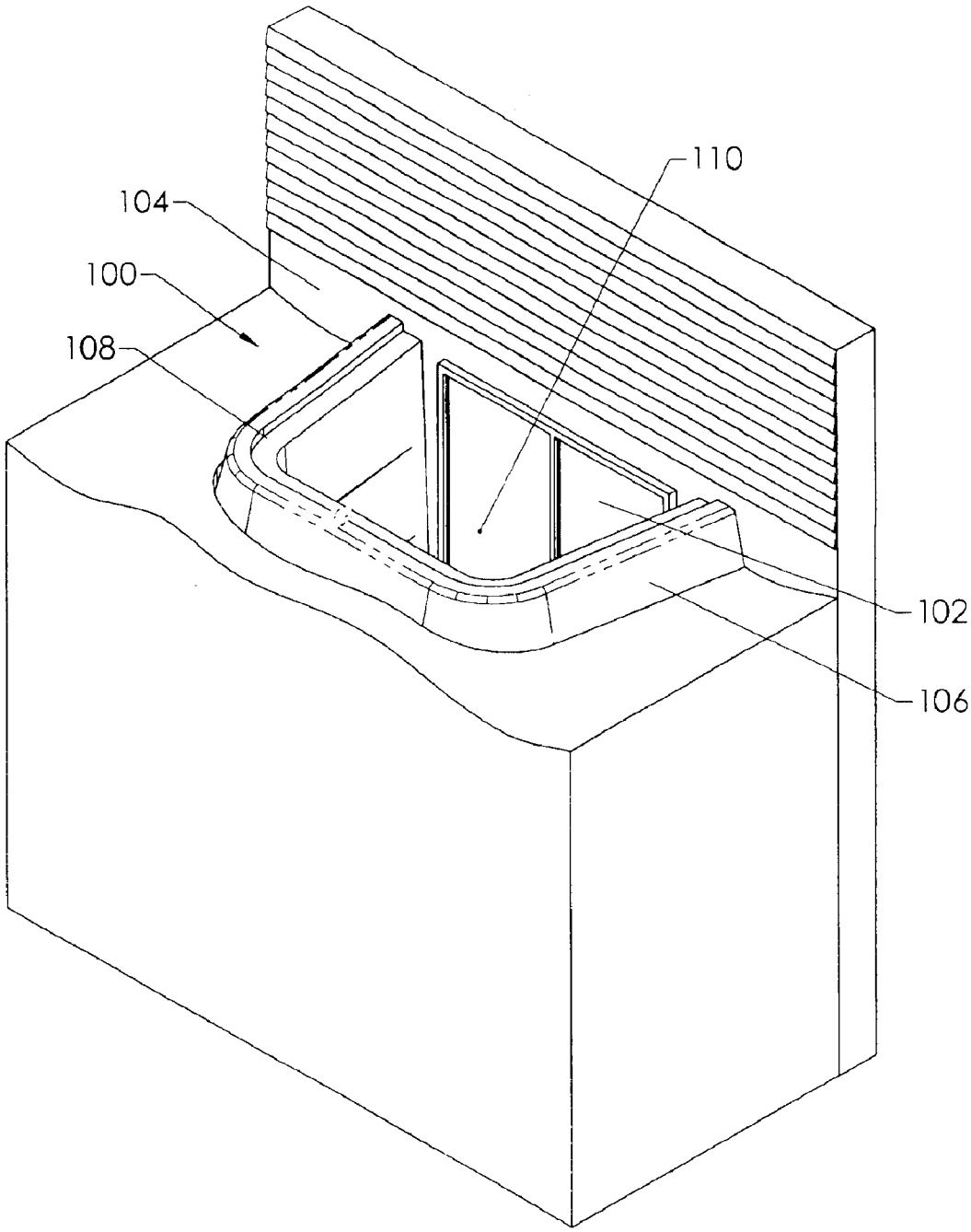
FIG. 1 is a view in perspective of one embodiment of the invention installed on a foundation of a building to space apart landscape fill from a window opening.

A currently preferred embodiment of the invention, generally indicated at 100, is illustrated in FIG. 1. The invention can be embodied as a rust-proof window well 100. A window well 100 according to the invention typically is manufactured from a composite material by applying the composite material onto a mold, curing the material, and removing the cured material from the mold. In contrast to metal walls, and even to galvanized metal walls, the composite material forming the walls of the instant invention are rust-proof. A preformed window well 100 generally weighs less than about 400 pounds, and typically can be installed by one, two, or sometimes three workers without requiring a crane, or other lifting device.

The pre-formed, or pre-manufactured, window well 100 generally is installed in an excavated area in front of a window 102 by bolting installation flanges onto the foundation of a building 104. Landscape fill can then be piled up against the exterior surface of the well 100. A mow strip 106 can accommodate a variable depth of fill, or a slope in the landscape across the window opening and/or away from the building. A caulking compound may additionally be applied to the flanges prior to installation of a well 100 to resist moisture penetration across the attach joint and into the window well 100. Since a window well 100 can be fairly deep, a support structure, such as shelf 108, desirably is provided to hold a safety cover (not illustrated) over the top opening 110 of the window well 100.

Figure 2:
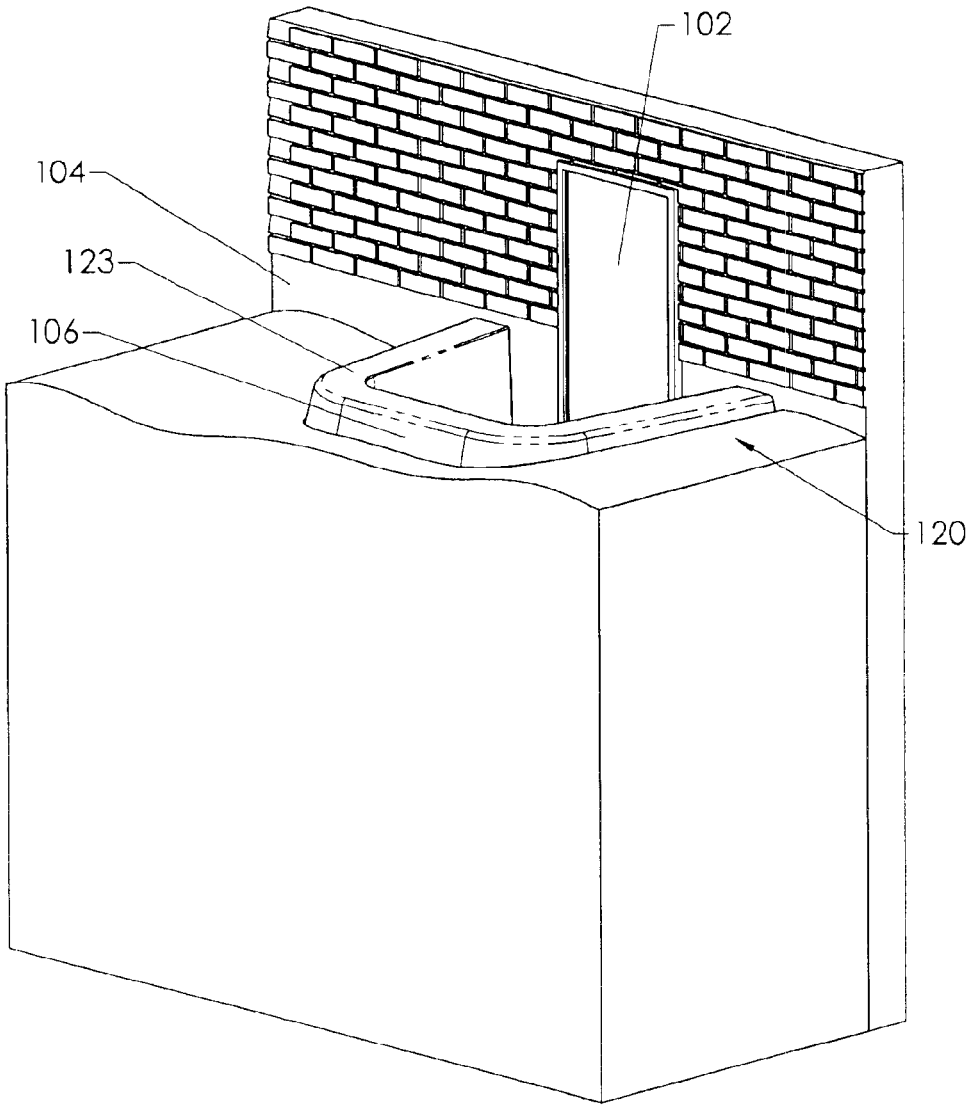
FIG. 2 is a view in perspective of an alternative embodiment of the invention installed on a foundation of a building to space apart landscape fill from a window opening.

An alternative embodiment of the invention, generally indicated at 120, is illustrated in FIG. 2. Again, the composite window well 120 typically is fastened to an exterior surface of a building 104 in an excavated area in front of a window 102. After attaching well 120 to the building, dirt or other landscape fill can be back-filled against the exterior surface of well 120. Typical fasteners used to secure a well 120 to a building or house 104 include mechanical fasteners, such as expansion bolts. Sometimes a sealing caulk also is used further to resist penetration of dirt or moisture across the attach joint.

Window wells according to the invention may be manufactured in a range of sizes to accomodate windows of various sizes and elevations below grade. A window well 120 may have a different depth compared to a window well 100. In certain shallow window wells, a safety shield may not be required, so shelf 108 can be eliminated, e.g. if desired to provide a different, possibly more pleasing, appearance. However, a water resistant barrier, such as a transparent bubble (not illustrated), may still be useful to resist water build-up inside a window well. Such a water resistant barrier can be supported on top portion 123. Of course, top portion 123 may also function to support a porous safety cover having a cooperating size and shape.

It should be noted that, merely as a convenience, right, left, front, and rear will be assigned to window well structure from the vantage point of a person standing inside an installed window well and looking toward the attached building. As illustrated in FIGS. 3 through 11, a window well 100 may include one or more steps 125 to assist a person in exiting the top opening 110 of a window well 100. Steps 125 also operate as flanges to stiffen the window well 100 to resist deflection of its walls due to the weight of back fill material. An enlarged toe hold area 126 may be formed in one or more locations to increase a size of a step 125 while maintaining a substantially vertical wall. The top surface or rim 127 may also serve as a functional step.

Figure 3:
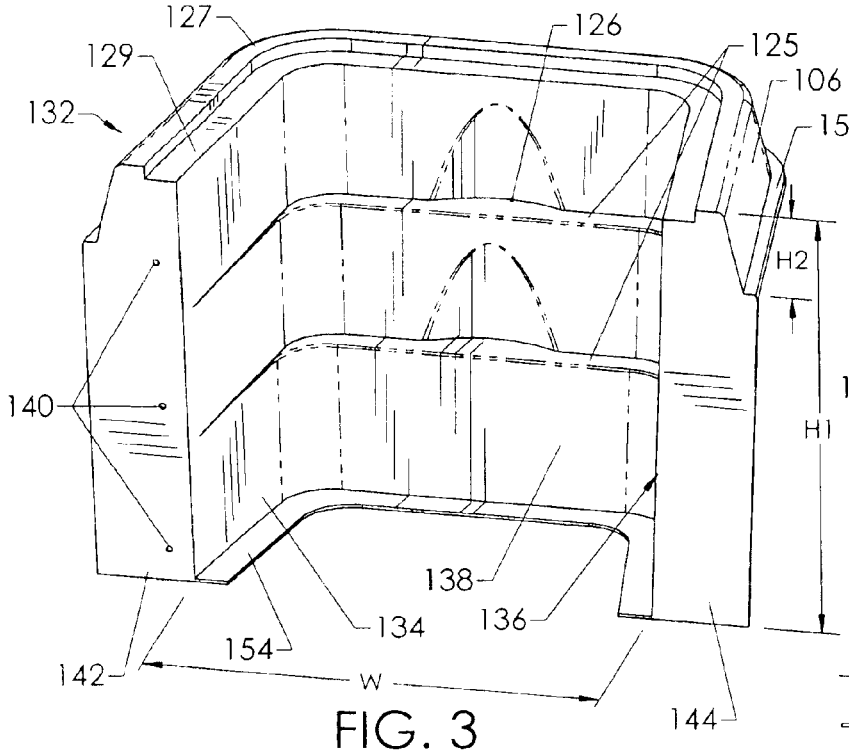
FIG. 3 is a view from above and in perspective of the interior of an embodiment of the invention.
Figure 5:
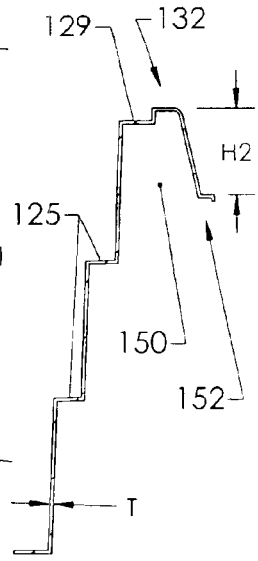
FIG. 5 is a cross-section profile taken through section 5—5 in FIG. 4 and looking in the direction of the arrows.
Figure 4:
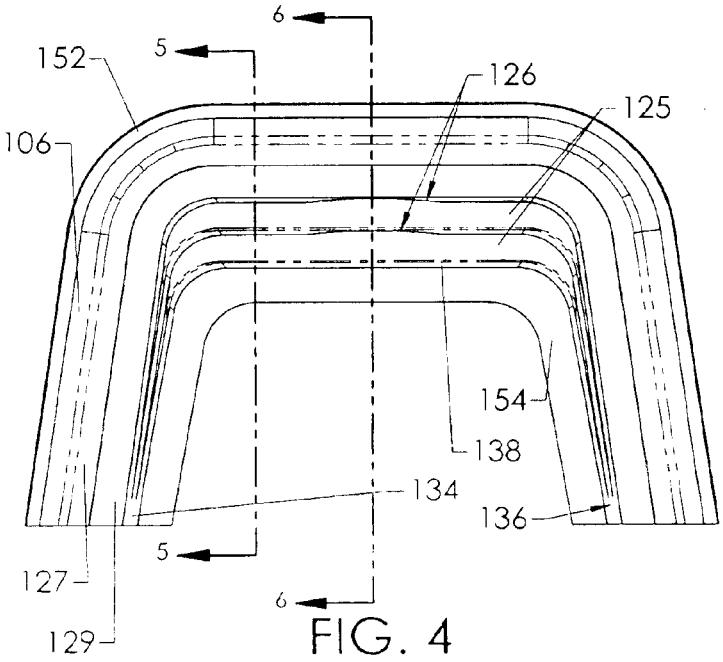
FIG. 4 is a top view of the embodiment illustrated in FIG. 3.
Figure 6:
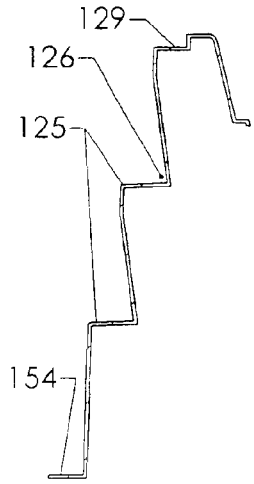
FIG. 6 is a cross-section profile taken through section 6—6 in FIG. 4 and looking in the direction of the arrows.
Figure 7:
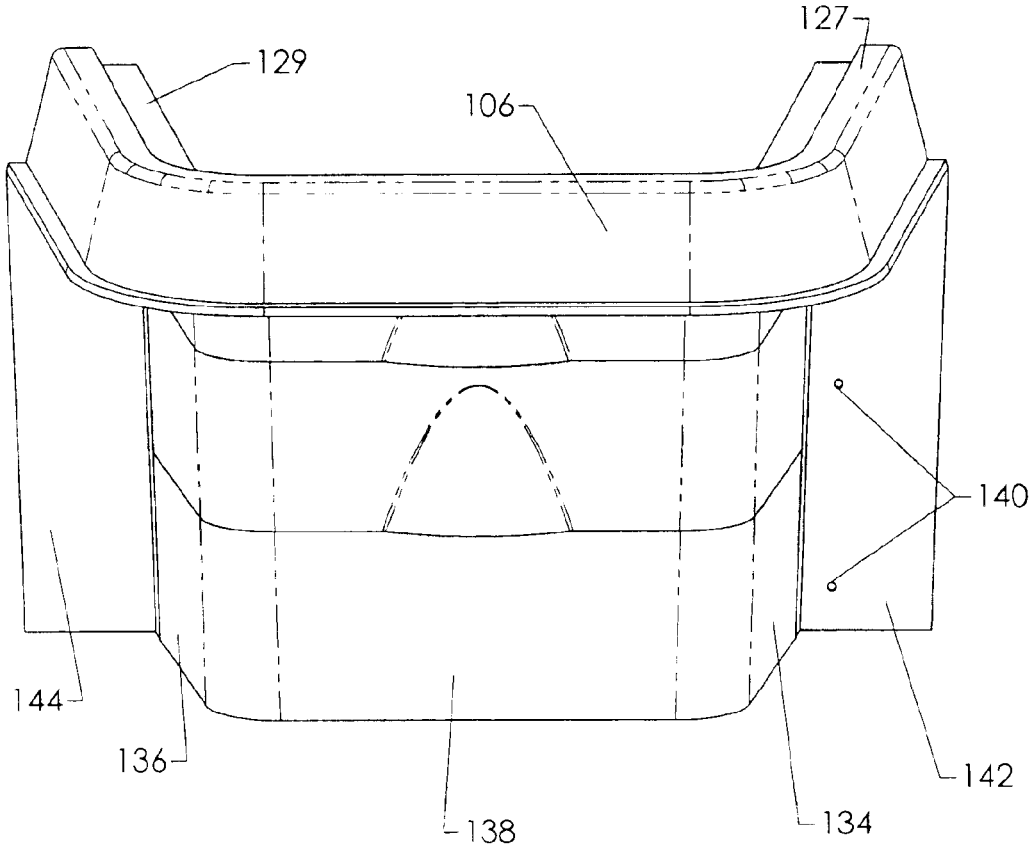
FIG. 7 is a view from above and in perspective of the exterior of the embodiment illustrated in FIG. 3.
Figure 8:
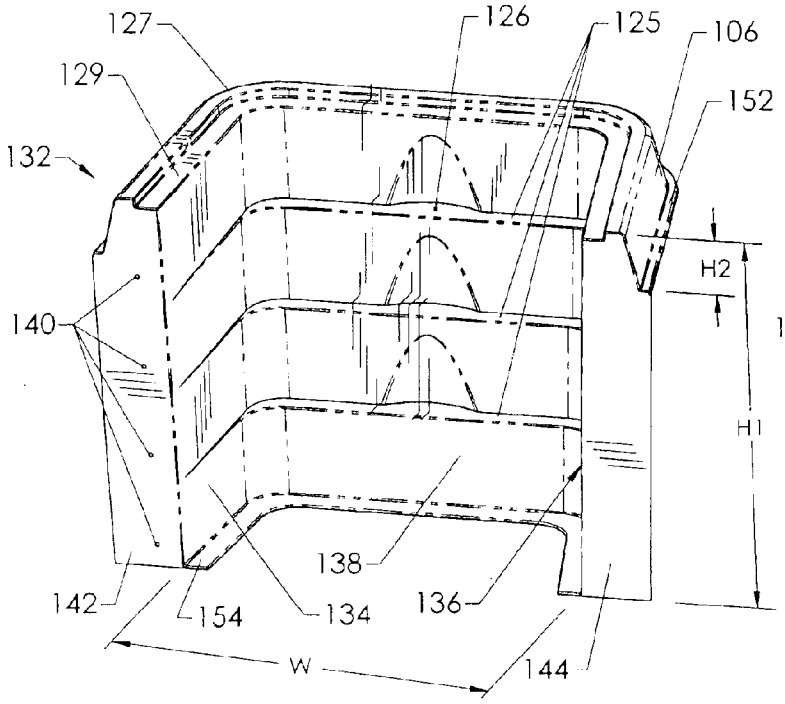
FIG. 8 is a view in perspective of the interior of an other embodiment of the invention.
Figure 10:
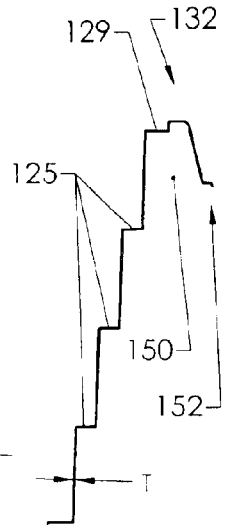
FIG. 10 is a cross-section view taken through section 10—10 in FIG. 9 and looking in the direction of the arrows.
Figure 9:
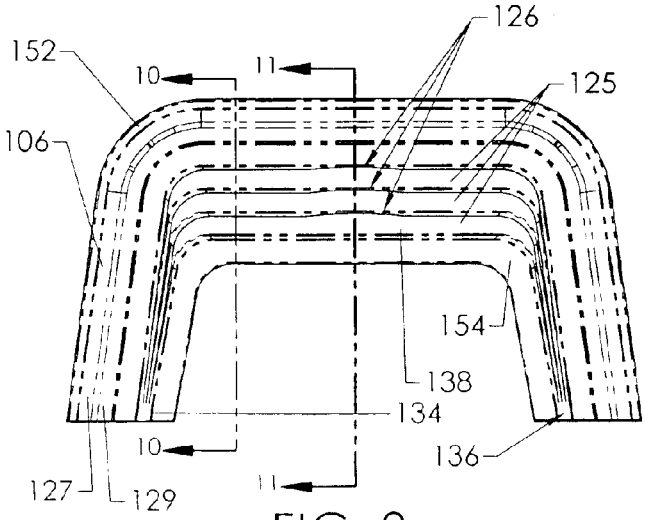
FIG. 9 is a top view of the embodiment in FIG. 8.
Figure 11:
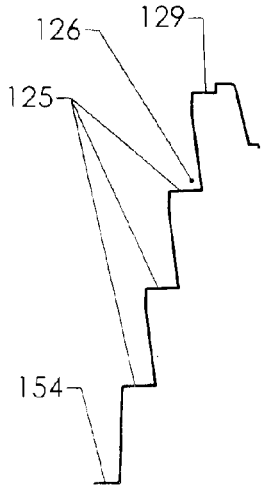
FIG. 11 is a cross-section view taken through section 11—11 in FIG. 9 and looking in the direction of the arrows.

As illustrated in FIGS. 3 and 8, it currently is preferred to provide a recessed ledge or shelf 129 formed at the top 132 of right wall 134, left wall 136, and rear wall 138. A ledge 129 forms a convenient support structure in which to receive a safety barrier or moisture resistant cover (not illustrated). Such a cover may be pushed out of the way by a person using the window well 100 as an escape route from within the building. Also as illustrated, a window well 100 generally has no front wall, since the building operates as such a wall. The bottom of the well 100 typically is open also to permit moisture to drain into the landscape fill. When a bottom floor is included in a window well, such as a well 100, one or more holes generally are provided to permit drainage of moisture. A common installation will place a layer of gravel, rock, or decorative stones to form a self-draining floor in a window well according to the invention.

With continued reference to FIGS. 3 and 8, one or more through-holes 140 may be provided in a flange, such as right-side flange 142. Since a flange 142 desirably includes a steel backer plate formed into the composite material of a window well, such as a well 100, it typically is preferred for holes 140 to be factory installed. However, as illustrated by left-hand flange 144, a flange 144 may be provided intact to permit hole spacing and location to be determined on the job site.

A rear wall 138 may be regarded as being connected at its opposite ends to cooperating ends of side wall 134 and side wall 136. In currently preferred embodiments, the junction between respective walls has a radius or curvature for aesthetic and structural reasons. While it is currently preferred to form a window well, such as well 100, as a single-piece component, it is within contemplation alternatively to make separate wall components for assembly in the field. However, a one-piece design advantageously minimizes dirt- and weed-catching cracks.

A window well according to the invention may be manufactured in a range of widths and heights, generally indicated by W and H1 respectively in FIGS. 3 and 8. A typical range in width W is between about 42 inches and about 75 inches. A typical range in height H1 is between about 30 inches and about 75 inches. Of course, certain embodiments may be manufactured having considerably larger or smaller dimensions. Preferred embodiments of a window well will include a mow strip 106. The height H2 of the mow strip 106, if present, can be adjusted based upon an expected range in external ground elevation across a window area. Typically, the height H2 of a mow strip 106 is about a foot, or so. One to four steps 125 and 127 are typical, although more are possible. Step 125 height is generally less than about 16 inches, as determined by code requirements. Window wells are typically constructed to meet International Residential Code (IRC) 2000 Egress code requirements. Certification under all other currently pertinent codes may be obtained for window wells constructed according to the invention.

The invention can have a finished exterior surface supplied by a gel coat, or a window well can be painted. Surface textures can also be molded into the finished part. Certain light enhancing colors are currently preferred to increase light transmission into a basement or below-grade room. The finish desirably is easy to retouch, and durable. A stipple or spatter-textured finish may be applied in certain embodiments. Reinforcement for a mow strip 106, such as by applying an external metal face, is within contemplation for surfaces expected to experience significant abrasion.

A method for manufacturing a window well according to the invention typically includes the steps of: a) providing a mold comprising a shape of the window well; b) applying an uncured material to the mold; c) curing the material; and d) removing the cured material from the mold. While generally made with a spray-up process from a glass/epoxy composite, the window well may be manufactured from a variety of composite materials using manufacturing techniques corresponding to the selected materials. Composite materials suitable for manufacture of a window well according to the invention are generally selected from: glass-epoxy, carbon-epoxy, glass-ester, glass-thermoforming compound, glass-thermosetting compound, x-thermoforming compound, and x-thermosetting compound, where x is a fiber. It is within contemplation to apply a core material between top and bottom skins formed from composite materials in a sandwich-type construction. Suitable cores include foams, expanded or extruded honeycomb-like structures, wood, and paper. A window well constructed according to the invention, and having a sandwich-type skin construction, could have a general wall thickness of perhaps 4 inches, or more in certain cases.

The currently preferred manufacturing method employs a chopper gun to apply a glass fiber and a resin in combination to a mold. A typical fiber/resin volume ratio in a cured composite is about 50%, although higher and lower ratios are also workable. Volume ratios are limited only by constituent material workability for manufacturing, and delivered threshold performance characteristics from the composite's mechanical properties. The resulting sprayed-up window well has a monocoque shell construction with substantially uniform thickness. Thicknesses of various locations also may be increased or decreased as desired to form a light weight and sufficiently strong construction. Certain highly loaded areas may also be built-up, as desired, using hand layup procedures. Currently desired monocoque shell thickness is between about ¼ inches and about ¾ inches.

One exemplary window well having a monocoque shell thickness of about ⅜ inches, a width of about 42 inches, and a depth of about 36 inches weighes approximately 135 pounds. It is expected that a larger size window well, having a width of about 72 inches and a depth of about 36 inches might weigh about 160 pounds. A reasonable upper limit for the weight of a prefabricated window well to be installed by only two people might be about 250 pounds.

A backer plate of metal desirably is included to reinforce the attach flanges 142 and 144. It is further within contemplation to add a filler, such as a foam, to a void space, such as space 150. Such an area 150 may also be capped by a layer of composite material to reinforce the top rim. Of course, a sandwich construction spacing apart two or more sprayed-up skins is within contemplation, besides the described monocoque construction. Flanges, including steps 125, top surface 127, and flanges 152 and 154 desirably add stiffness to flat panel areas to resist panel deformation under the weight of back fill material.

The mold used to manufacture window well 100 has both male and female portions. It is within contemplation to use either an entirely female mold or an entirely male mold to manufacture alternative embodiments of the invention. A draft generally is incorporated in the mold to assist in part separation from the mold subsequent to cure of the composite. The draft also can help form nestable window wells to reduce required shipping volume of a plurality of window wells. It currently is preferred to incorporate a slope into the mold for all aproximately horizontal surfaces to facilitate drainage of water from such surfaces in an installed window well.

While the invention has been described in particular with reference to certain illustrated embodiments, such is not intended to limit the scope of the invention. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A window well weighing less than about 400 pounds, comprising:

a rust-proof containment surround defining a volume to space a landscape fill apart from a below-grade window, wherein:

said containment surround comprises at least one substantially planar section having a visible surface disposed inside an installed said window well;

a vertical size of said visible surface comprises a size that is about the same size as a vertical distance between a bottom level of said surround and a surface of an egress step formed in a first wall of said surround; and:

said egress step comprises a platform disposed near a center of said first wall and configured to support a user's foot, said platform further comprising an enlarged toe-hold area forming a localized volume addition to a theoretical volume defined by said first wall inside an installed said window well.

2. The window well of claim 1, further comprising:

a mow strip configured to accommodate a grade in said landscape fill, wherein:

said mow strip is arranged as a second wall offset in an outward direction from said first wall and depending from structure associated with a top of said first wall, a vertical size of said second wall being about one foot, or more.

3. The window well of claim 1, further comprising:

a support ledge formed in a wall of said surround, said ledge being adapted to hold a safety cover over an opening of said well and providing a vertically disposed stop structure arranged for contact with an edge of said cover to resist motion of said cover in a horizontal direction.

4. The window well of claim 3, in combination with a safety cover comprising a grate.

5. The window well of claim 3, in combination with a substantially transparent safety cover operable to resist passage therethrough by water.

6. The window well of claim 1, wherein:

walls forming said surround comprise a composite material selected from the group consisting of: glass-epoxy, carbon-epoxy, glass-ester, glass-thermoforming compound, glass-thermosetting compound, fiber-thermoforming compound, and fiber-thermosetting compound.

7. A window well, comprising:

a three-sided container comprising premanufactured first, second, and third walls, and an open top; wherein:

said first and third walls each carry attach structure on their first end; said attach structure being adapted to attach to foundation structure of a building; with a second end of said first and third walls being connected to said second wall to enclose a volume; and said second wall comprises integral egress steps formed by arranging an integral surface of said second wall to create a 3-dimensional enhanced-step structure providing an egress ladder from within said window well, said ladder comprising a portion disposed near a center of said second wall; wherein:

said enhanced-step structure is associated with flange structure configured and arranged operably to resist bending deformation of at least one substantially planar section comprised by said second wall, and said enhanced step structure further comprises an enlarged toe hold area configured to increase a size in a depth direction of a local portion of a step.

8. The window well of claim 7, wherein:

said first, second, and third walls are formed as a unitary structure defining a volume prior to installation of said window well onto a house and:

a fourth wall is arranged to depend from structure associated with a top of said first, second, and third walls, said fourth wall being offset by a distance in an outward direction from said first, second, and third walls and arranged to form a mow strip capable of providing a finished surface disposed substantially vertically around a perimeter of said window well, said finished surface having a vertical size larger than about one foot and operable to accommodate a slope at a surface of back-fill material for an installed said window well.

9. The window well of claim 7, wherein:

said substantially planar section comprises a visible surface disposed inside an installed window well; and a vertical size of said at least one substantially planar section comprises a size that is about the same size as a vertical distance between two adjacent steps.

10. An improved window well of the type having prefabricated walls adapted to space a landscape fill material apart from a below-grade window, the improvement comprising:

egress steps formed as an integral portion of one of said walls by arranging a continuous interior surface of said one wall to form a 3-dimensional step structure comprising a substantially horizontal shelf having a length sized in harmony with a length of said one wall, said shelf comprising an enhanced step portion, wherein:

a step width of said enhanced step portion is sized to span less than a full width of said one wall; and a length of said enhanced portion in a step depth direction is larger than a corresponding length of said shelf to provide additional space on said step portion to receive a user's foot for egress purposes.

11. The window well of claim 10, further comprising:

a support formed as an integral portion of each of said walls by arranging a continuous surface of said walls to form a 3-dimensional socket structure comprising a substantially horizontal surface disposed around a perimeter at a top of said walls and operable to hold a window well cover to resist motion of said cover in a vertical direction, a perimeter wall of said socket structure being arranged to resist motion of said cover in a horizontal direction.

12. The window well of claim 11, further comprising:

a mow strip arranged as a surface extending from said walls and disposed to depend from a periphery around a top of said walls and exterior to said shelf, said mow strip being arranged to provide a substantially vertical exterior wall that is offset from said walls in a direction outwardly from said window well; wherein:

a vertical length of said exterior wall is adapted for at least partial-depth burial in said landscape fill and arranged to accommodate a grade in said landscape fill.

13. The window well of claim 10, wherein:

said walls have a thickness greater than about ¼ inch.

14. The window well of claim 10, wherein:

said walls have a thickness between about ¼ and about ¾ inches.

15. The window well of claim 10, wherein:

said walls have a thickness between about ¼ and about 4 inches.

16. The window well of claim 10, wherein:

said walls comprise a sandwich construction having a core disposed between top and bottom face sheets.

17. The window well of claim 10, wherein:

said walls are preformed walls comprising areas having substantially no curvature along a path in a vertical direction.

18. A method of installing a window well to a foundation of a house to space a landscape fill apart from a below grade window, comprising the steps of:

a) providing a window well comprising a wall with a first step and a second step formed in said wall, wherein;

said first step comprises an approximately vertical first rise portion and an approximately horizontal first run portion operable to receive a foot for purpose of egress, and said second step comprises an approximately vertical second rise portion and an approximately horizontal second run portion operable to receive a foot for purpose of egress, said second rise portion including an undulation configured to enhance a toe hold portion of said first step, said toe-hold portion having a size in a depth direction of said first run that varies across a width of said first run, wherein:

said second rise portion is offset in a horizontal direction from said first rise portion effective to increase a volume defined within said window well b) attaching a flange associated with a wall of said window well to said foundation; and c) back-filling said landscape fill into a position about an exterior of said window well.

19. The method according to claim 18, further comprising the step, prior to step b), of:

applying a caulking compound to an attach surface of said flange.

20. A window well, comprising:

a first wall comprising an integral 3-dimensional surface arranged to form a plurality of egress steps, at least one egress step comprising an approximately horizontal portion and an enlarged toe-hold area disposed on said approximately horizontal portion of said egress step and forming a localized volume addition inside an installed said window well.

21. The window well of claim 20, further comprising:

a mow strip comprising a second wall arranged as a double wall that is offset from said first wall in an outward direction, said second wall depending from structure associated with said first wall and arranged to provide a visible finished surface operable to accommodate a grade in landscape fill disposed in contact with an installed said window well, a vertical size of said second wall being at least about one foot.

* * * * *